US006129243A

United States Patent [19]

Pal et al.

[11] Patent Number: 6,129,243

[45] Date of Patent: Oct. 10, 2000

[54] DUAL TUBE DISPENSER AND ADAPTOR

[75] Inventors: Nagesh Keshav Pal, Thane; Shashank Vaman Dhalewadikar; Colin Prottey, both of Bombay, all of India

[73] Assignee: Chesebrough-Pond's USA Co., division of Conopco, Inc., Greenwich, Conn.

[21] Appl. No.: 08/733,034

[22] Filed: Oct. 16, 1996

[30] Foreign Application Priority Data

Oct. 16, 1995 [GB] United Kingdom ..... 9521124

[51] Int. Cl.[7] ..... B65D 35/22

[52] U.S. Cl. ..... 222/94; 222/105; 222/145.3

[58] Field of Search ..... 222/92, 94, 105, 222/129, 145.1, 145.3, 145.5

[56] References Cited

U.S. PATENT DOCUMENTS 4,340,154 7/1982 VanManen ..... 222/94
4,585,149 4/1986 Zulauf ..... 222/94
5,360,144 11/1994 Slade ..... 222/145.3
5,823,387 10/1998 Manadanas et al. ..... 222/145.3

*Primary Examiner*—Joseph A. Kaufman
*Attorney, Agent, or Firm*—Milton L. Honig

[57] ABSTRACT

The invention relates to an adaptor which enables two premade tubes such as toothpaste tubes of varying sizes to be fitted together, one inside the other to obtain a dual tube dispenser providing for separate storage of two dissimilar substances and its co-extrusion from the dispenser as and when desired upon application of external pressure on the latter. The adaptor includes a threaded component in the form of a cap with internal threads to match the threads of the neck portion of conventional toothpaste tubes. A central passage provided in the adaptor communicates with the inside of the tube to which it is screw-fitted. The adaptor is further provided with press-fitting studs to hold the tube coaxially within a larger tube to obtain a dual tube dispenser, the press-fitting studs being capable of forming a press-fit connection in the internal portion of the neck of the larger tube.

10 Claims, 7 Drawing Sheets

DUAL TUBE DISPENSER AND ADAPTOR

BACKGROUND OF THE INVENTION

1. Field of the Invention

The present invention relates to a dual tube dispenser and an adapter for use in such dual tube dispenser for separate storage of two dissimilar substances which are to be kept separate for one reason or another, e.g. because they are mutually chemically reactive and/or physically incompatible with respect to one another, or because one wants to have perceptually attractive product forms with e.g. different colours, and simultaneous dispensing when combined use of such substances is required by application of external pressure on the dispenser body which is deformable.

2. The Related Art

Certain health & beauty aids, cleansing compositions and in particular, dental formulations sometimes require dual or multicompartment containers for storage of such dissimilar substances, e.g. mutually chemically reactive and/or physically incompatible substances for simultaneous dispensing of the same for combined end uses as and when desired.

There are already dual compartment dispensers for dental formulations known wherein two dentrifrice portions, each of which includes a component which is chemically reactive with another component in the other portion, with the portions being maintained separate from each other in said dispenser by means of a separator membrane which is formed of an extrudable material which is non-reactive with either of the two dentifrice portions stored together. Although in such known dispensers, the purpose of effective storage of the two reactive substances and/or physically incompatible substances and simultaneous release of the same for combined end use is achieved, the manner of manufacture of such known dispensers is cumbersome, time consuming and is also expensive. Importantly, the manufacture of such dual compartment dispensers involves substantial modification in dispenser manufacturing machinery and requires special filling aids for the dispenser contents.

It is thus the basic object of the present invention to provide for a dispensing container which would be effective in storing separately two dissimilar substances which are mutually reactive and/or physically incompatible and/or perceptually different and which also provides for simultaneous release of both said substances as and when required, for combined end uses upon application of external pressure on the dispenser body portion which is deformable.

A further object of the present invention is to provide for a dual tube dispenser container utilizing conventional tube manufacturing and filling-in-aids.

Yet another object of the present invention is to provide for an adapter by which conventional stock tubes such as toothpaste tubes of varying sizes can be utilised to produce dual tube dispensers for storing and simultaneous extrusion as and when necessary, of two dissimilar substances for combined end uses.

Yet another object of the present invention is to provide for a simple and cost-effective manner of manufacture of dual tube dispensers.

SUMMARY OF THE INVENTION

According to one aspect of the present invention the same provides for a dual tube dispenser assembly for separate storage of two dissimilar materials such as herein described and simultaneous dispensing of said materials as and when required comprising:

a small tube containing one said material and having a deformable body portion;

an adapter secured to the mouth and/or neck portion of said small size tube and having at least one passage communicating with the inside of said small size tube;

said adapter further having means to co-axially retain said small size tube secured thereto internally and with respect to a large tube latter also having a deformable body portion;

the intermediate space there between the external surface of said small size tube with adapter and the internal surface of the large size tube containing the other of said dissimilar materials such that upon application of force/pressure on the deformable body portion of the large size tube said dissimilar materials from said small size tube and said intermediate space dispense simultaneously from the mouth portion of said large size tube; and a closure for said mouth of the large size tube.

According to a further aspect of the present invention the same provides for an adapter for use in said dual tube dispenser comprising:

a body portion having a cylindrical base and tubular extension thereof at the top;

means provided in said cylindrical base to releasably secure with respect to said small tube neck/mouth portion;

means provided externally on at least a portion of said body portion to press fit and hold said smaller tube, detachably secured thereto at its cylindrical base portion, co-axially within and with respect to at least a portion of the internal surface of said large tube;

said body portion defining at least one passage communicating with the inside of said smaller tube and at least one further passage defined by at least a portion of the external surface of said body portion and the internal surface portion of the larger tube for communicating with the intermediate space there between the external surface of the smaller tube and the inside of the larger tube housing said smaller tube.

According to yet further aspect of the present invention there is disclosed a method for producing the dual tube dispenser having separately stored two dissimilar materials such as herein described and having means for simultaneous dispensing of said dissimilar materials as and when desired comprising:

providing an open ended empty small size tube with a releasably secured closure fitted thereon;

filling-in one of said dissimilar material into said small size tube by means of a filling machine through said open end of said small size tube followed by crimping and sealing the open end after filling is completed;

replacing the releasable closure of the thus filled small size tube by the adapter such as herein described to thereby secure the adapter base with respect to the mouth/neck portion of said small size tube;

providing an open ended empty large size tube with its releasable closure fitted thereon;

inserting the small size tube fitted with the adapter into said large size tube through its open end and press fitting the adapter external surface portion with respect to the internal surface/configuration of said large tube to thereby hold said small size tube co-axially within said large size tube;

filling in the intermediate space defined by the external surface portion of the small size tube with adapter and the internal surface of the large size tube with the other of said dissimilar materials through the open end of said large size tube by a filling machine followed by, crimping and sealing the open end of the large size tube after filling is completed to thereby provide the dual tube dispenser.

Thus the adapter for use in dual tube dispenser of the invention would enable two premade tubes such as toothpaste tubes of varying sizes be fitted together, one inside the other to obtain a dual tube dispenser providing for separate storage of two dissimilar substances and its co-extrusion from said dispenser as and when desired upon application of external pressure on the latter. Optionally, such dispensers may be fitted with specifically designed caps (screw-on or flip top) having appropriate annular ring and spigot to safeguard against cross contamination at the orifice.

Preferably the adapter according to the invention comprises a threaded component in the form of a modified cap with internal threads to match the threads of the neck portion of conventional toothpaste tubes. One of the several configurations of the adapter is for a central passage provided in the adapter communicating with the inside of the smaller tube to which it is screw fitted. The adapter is further provided with press-fitting means to hold the tube coaxially within a larger tube to obtain the dual tube dispenser of the invention, said press-fitting means being capable of forming a press-fit connection in the internal portion of the neck of the larger tube. The threaded component can be made by any conventional method and materials, and is preferably made by injection moulding if plastic materials are used.

BRIEF DESCRIPTION OF THE DRAWING

The invention, its objects and advantages will be more apparent from the ensuing detailed description of a non-limiting exemplary embodiment of the adapter and the dual tube dispenser utilizing such adapter according to the invention made with relation to the accompanying drawings wherein.

DETAILED DESCRIPTION OF THE INVENTION

Figure 1:
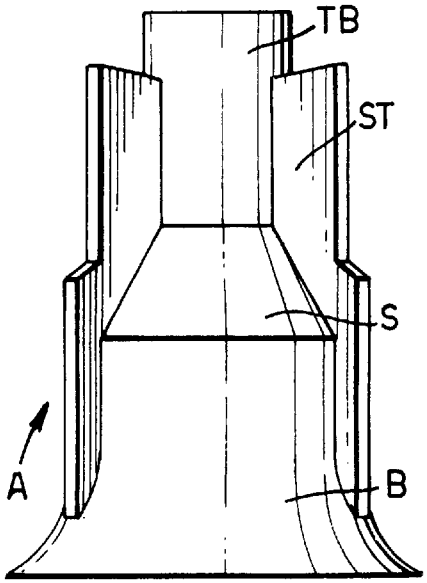
FIG. 1 is an elevational view of a first embodiment of the adapter according to the present invention.
Figure 2:
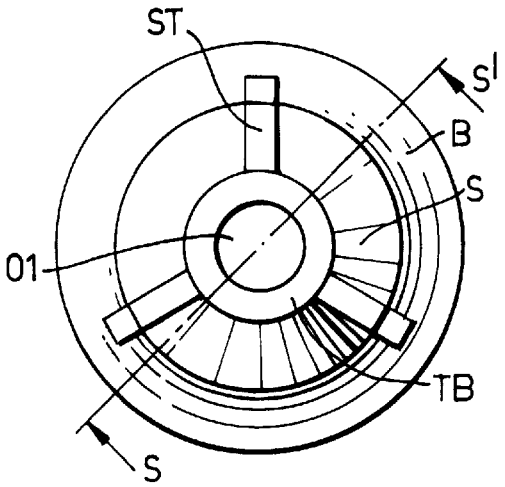
FIG. 2 is a top plan view of the adapter according to FIG. 1.
Figure 3:
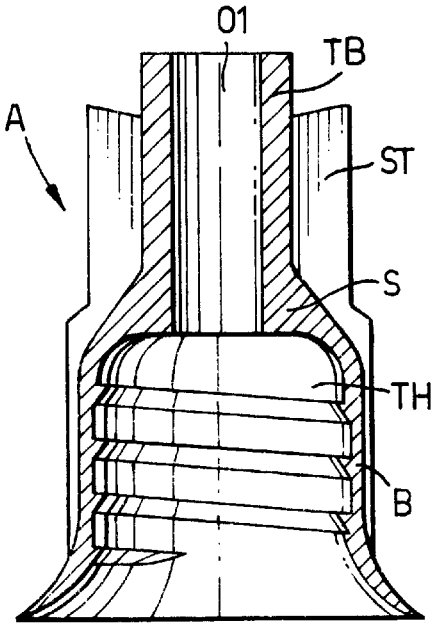
FIG. 3 is a sectional elevational view of the adapter taken along line S-S' in FIG. 2.

Reference is first invited to FIGS. 1 to 3 which illustrate first embodiment of the adapter of the invention. FIG. 1 shows the adapter generally indicated by reference (A) in an elevational view. As clearly illustrated in said figure, the adapter (A) is basically composed of a cylindrical base portion (B) with a contiguous shoulder (S), the latter extending to form a tubular extension (TB) at the top. A plurality of extending studs (ST) are moulded onto the adapter (A). Each stud (ST) originates near the base (B) and extends upwards along shoulder (S) to just under the top edge of the tubular extension (TB).

Reference is now made to FIG. 2 which illustrates the adapter construction in top plan view. As clearly represented in said figure, the adapter has a central passage (O) which communicates with the inside of a small tube (such as a toothpaste tube with nominal diameter of 19 mm) to which it is screw fitted. The figure represents in top plan view the base (B), the shoulder (S), the tubular extension (TB) and the studs (ST) of the adapter formed according to the invention.

In FIG. 3, the adapter (A) is shown in a sectional view along line S-S' of FIG. 2. As represented in said figure, the adapter is provided with internal threads (TH) corresponding to the threads of the neck portion of any conventional tube, said tube having a smaller size orifice than the tube into which it is press-fitted (hereafter called the smaller and the larger tube respectively). Further, the base (B), shoulder (S), the tubular extensions (TB), studs (ST) and the central opening (O) of the adapter are illustrated in said sectional view. According to the first embidiment described above, the central opening (O) is shown to have a circular and concentric inner opening with respect to the opening of the smaller tube into which the adapter is secured by means of threads (TH) of the adapter and corresponding threads on the neck of the small tube.

Reference is now invited to FIGS. 4 to 17 which illustrate further embodiment of the adapter of the invention.

Figure 4:
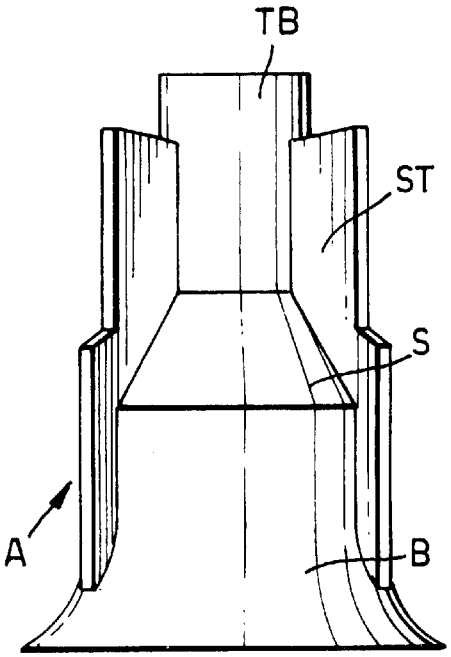
FIG. 4 is an elevational view of a second embodiment of the adapter of the present invention.
Figure 5:
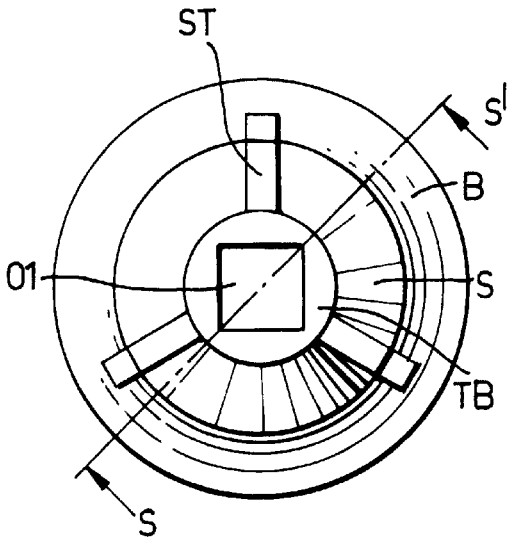
FIG. 5 is a top plan view of the adapter of FIG. 4.
Figure 6:
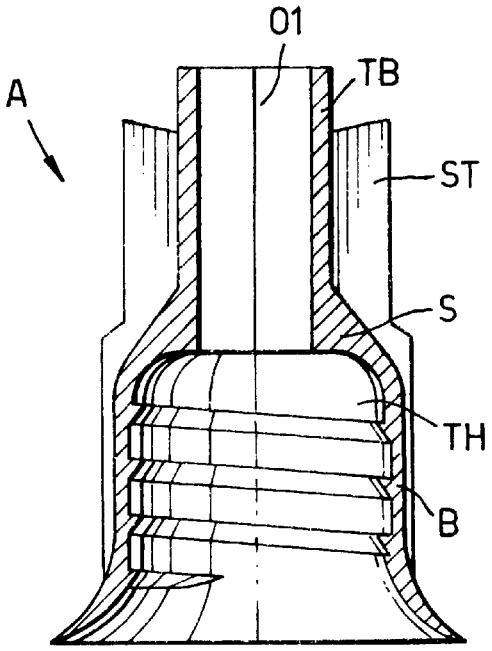
FIG. 6 is a sectional elevational view of the adapter taken along line S-S' of FIG. 5.

The second embodiment illustrated with respect to FIGS. 4 to 6 shows the adapter having a cylindrical base (B) which extends along shoulder (S) to form the tubular extension (TB). The studs (ST) are shown originating from the base (B) and extending along shoulder (S) to a position just under the top of the tubular extension (TB). In this second embodiment the basic features of the adapter comprising the cylindrical base (B), the shoulder (S), the tubular extension (TB), the central opening (O1) and the studs (ST) are provided like that of the first embodiment illustrated with reference to FIGS. 1 to 3. However, in this second embodiment, the internal shape and configuration of the tubular extension (TB) is provided to obtain a square shaped central opening (O1) to thereby obtain square shaped dispensing of the contents of the smaller tube to which the opening (O1) is in communication.

Figure 7:
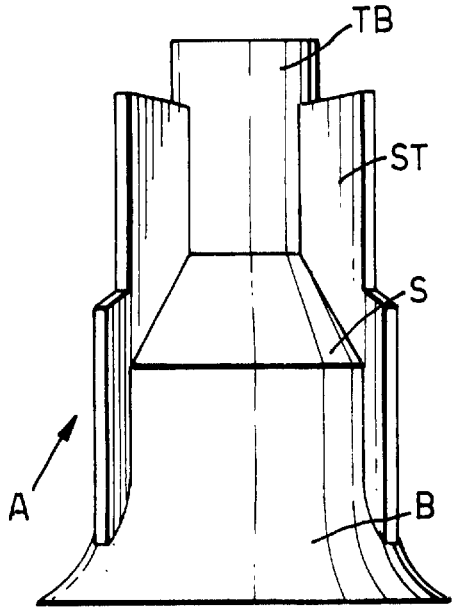
FIG. 7 is an elevational view of a third embodiment of the adapter of the invention.
Figure 8:
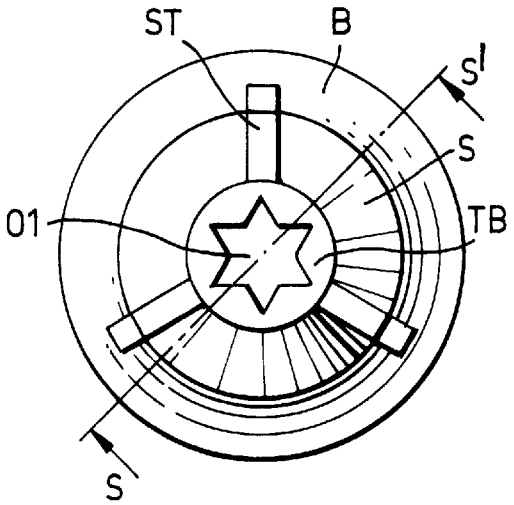
FIG. 8 is a top plan view of the adapter of FIG. 7.
Figure 9:
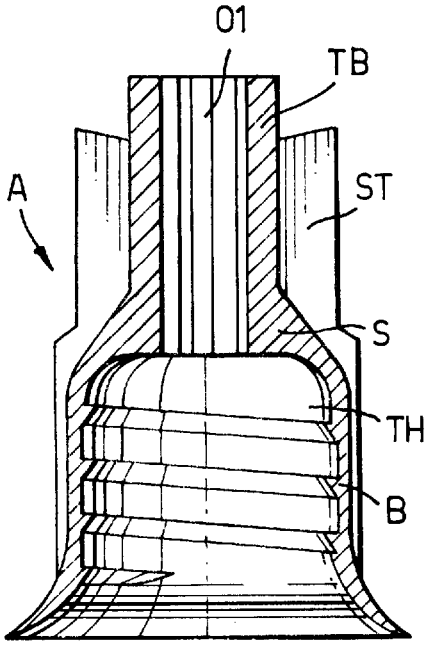
FIG. 9 is a sectional elevational view of the adapter taken along line S-S' of FIG. 8.

The third embodiment illustrated with respect to FIGS. 7 to 9 show the adapter having a cylindrical base (B) which extends along shoulder (S) to form the tubular extension (TB). The studs (ST) are shown originating from the base (B) and extending along shoulder (S) to a position just under the top on the tubular extension (TB). In this third embodiment the basic features of the adapter comprising the cylindrical base (B), the shoulder (S), the tubular extension (TB), the central opening (O1) and the studs (ST) are provided like that of the first embodiment illustrated with reference to FIGS. 1 to 3. However, in third embodiment, the internal shape and configuration of the tubular extension (TB) is provided to have a star shaped central opening (O1) to thereby obtain star shaped dispensing of the contents of the smaller tube to which the opening (O1) is in communication.

Figure 10:
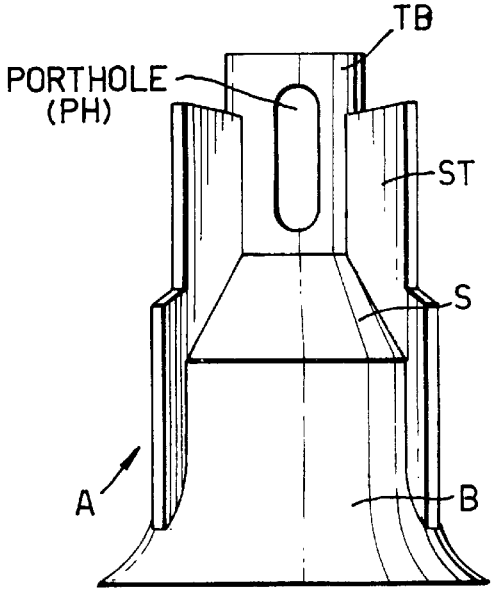
FIG. 10 is an elevational view of a fourth embodiment of the adapter of the present invention.
Figure 11:
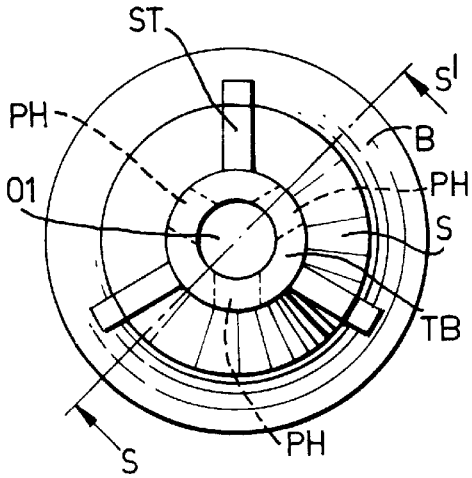
FIG. 11 is a top plan view of the adapter of FIG. 10.
Figure 12:
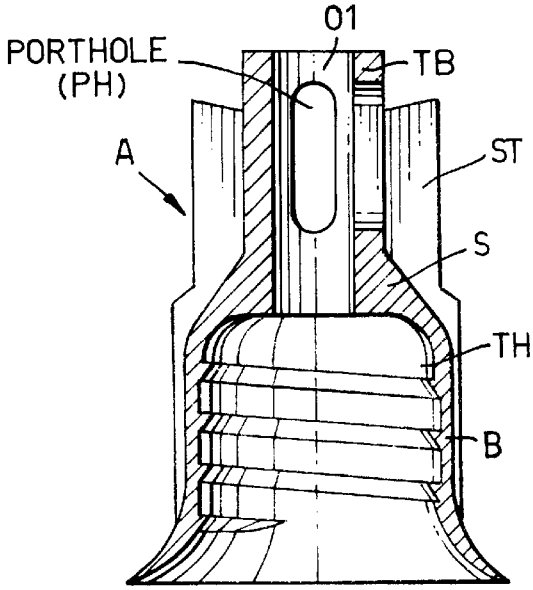
FIG. 12 is a sectional elevational view of the adapter taken along line S-S' of FIG. 11.

The adapter according to the fourth embodiment is illustrated with respect to FIGS. 10–12. In this fourth embodiment, the adapter is also having the same basic features of the cylindrical base (B), the shoulder (S), the tubular extension (TB), the central opening (O1) and the studs (ST) like that of the first embodiment. However, according to this fourth embodiment, the tubular extension (TB) is shown to be provided with port hole (PH) at its side in addition to the central opening (O1). Thus, according to this embodiment, the contents of the smaller tube can be dispensed through in addition to the central opening (O1), the port holes (PH) located in the side walls of tubular extension (TB). Optionally, the dispensing from the central opening (O1) may be suitably blocked, as and when desired.

Figure 13:
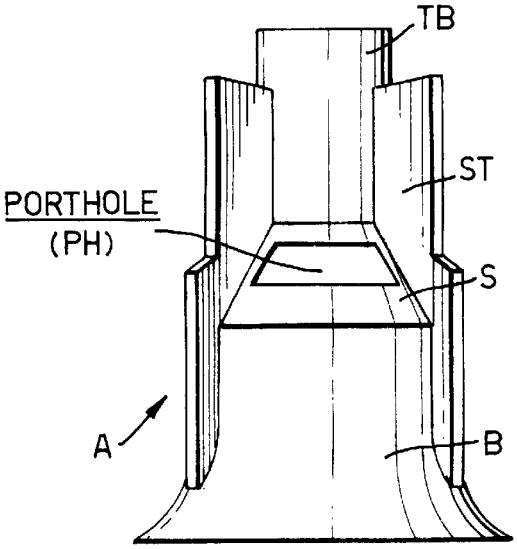
FIG. 13 is an elevational view of a fifth embodiment of the adapter according to the present invention.
Figure 14:
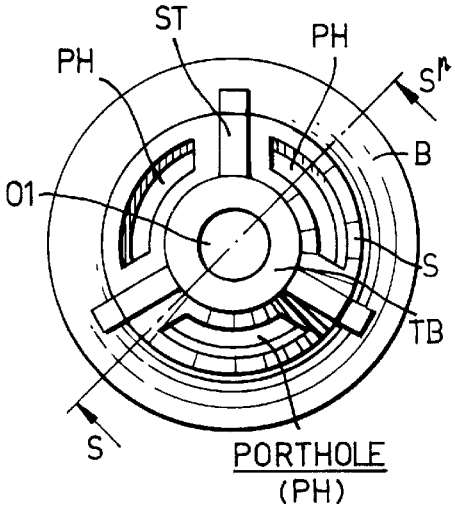
FIG. 14 is a top plan view of the adapter according to FIG. 13.
Figure 15:
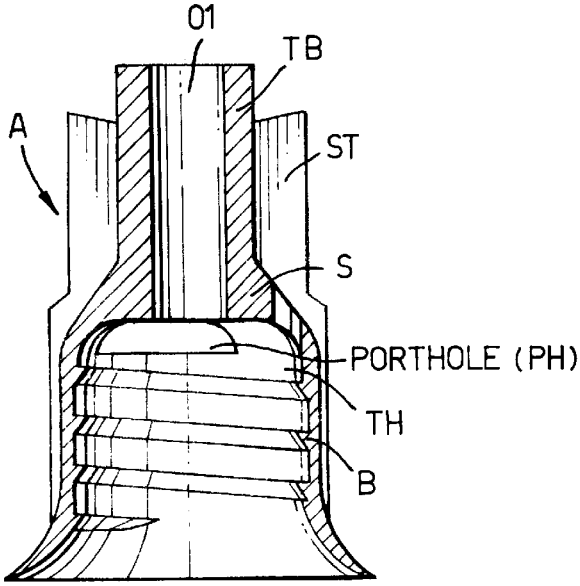
FIG. 15 is a sectional elevational view taken along line S-S' of FIG. 14.

Reference is now invited to the fifth embodiment of the adapter of the invention illustrated in FIGS. 13–15. As illustrated in said figures the adapter of this fifth embodiment is also having the basic features of cylindrical base (B), the shoulder (S), the tubular extension (TB), the central opening (O1) and studs (ST) like that of the first embodiment. However, in this embodiment, the adapter is shown to have port holes (PH) provided on the shoulder (S). Thus according to this embodiment the contents of the smaller tube can be dispensed through, in addition to the central passage (O1), the port holes (PH) in the shoulder. Optionally, the dispensing from the central opening (O1) may be suitably blocked, as and when desired.

The shape and the number of port hole(s) as illustrated in FIGS. 10–15 may vary depending upon the contents to be dispensed and/or the end use.

It is also possible to vary the shape and configuration of the external surface of the adapter body portion in particular the tubular extension thereof and/or the studs with or without the modification in the internal shape and configuration of the tubular extension [the central opening (O1)] to achieve further modified shaped dispensing of the contents through the adapter for use in dual tube dispenser of the present invention.

Figure 16:
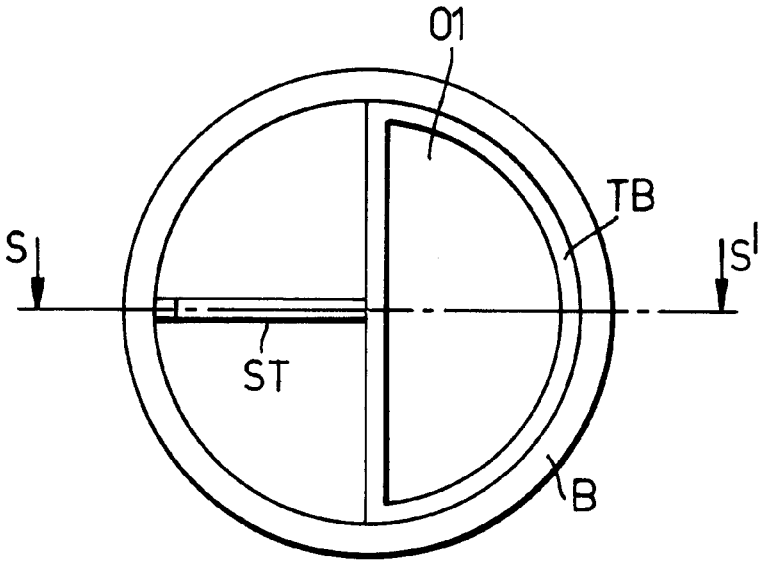
FIG. 16 is a top plan view of a seventh embodiment of the adapter of the invention.
Figure 17:
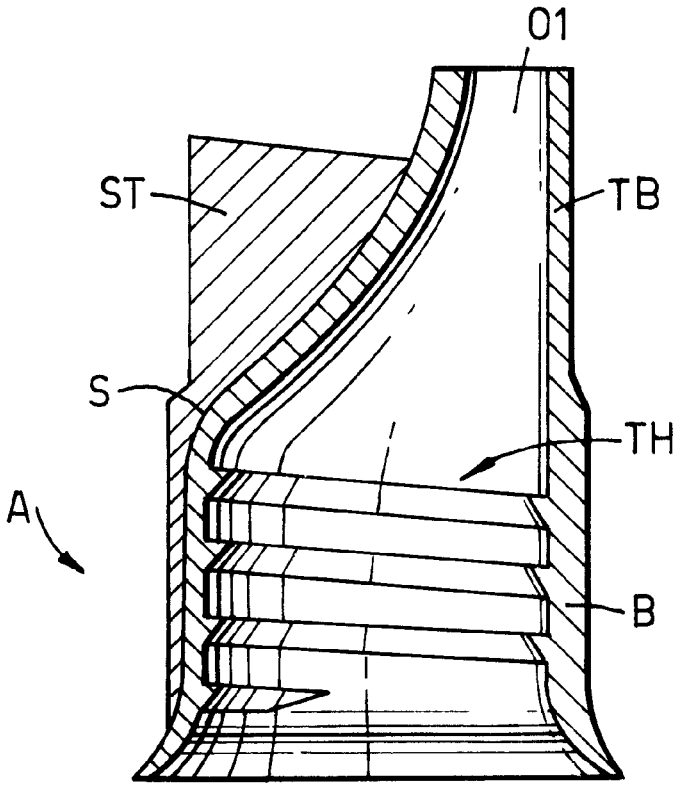
FIG. 17 is a sectional view taken along line S-S' of FIG. 16.

Reference is now invited to a further sixth embodiment of the adapter of the invention illustrated in FIGS. 16 and 17. As represented in FIG. 17, the sectional view along S-S' of FIG. 16, the adapter is having a cylindrical base (B) which extends along shoulder (S) to constitute a non-concentric semicircular shaped central opening (O1) as clearly viewed in the top plan view of FIG. 16. The studs (ST) in this embodiment also extend from the cylindrical base (B), upwardly tapering to just under the top edge of the semicircular shaped opening (O1).

The central opening (O1) in the sixth embodiment thus provides a non-concentric semicircular shaped dispensing passage for the contents of the smaller tube in the dual tube dispenser assembly of the invention. The external dimensions of the studs (ST) and atleast a portion of the adapter body portion provides for press-fit connection with respect to the internal dimensions of the neck of the larger tube to which the adapter is press fitted to hold and house the small size tube co-axially within the larger tube in the dual tube dispenser of the invention.

Although the exemplary embodiments illustrated represent adapter variations based on single differentiator (shape/size of opening, inclusions of portholes), one may combine plurality of such features as appropriate to obtain the desired adapter.

Reference is now made to FIGS. 18A to 18D which show the method of producing the dual tube dispenser utilizing the adapter according to the present invention.

Figure 18A:
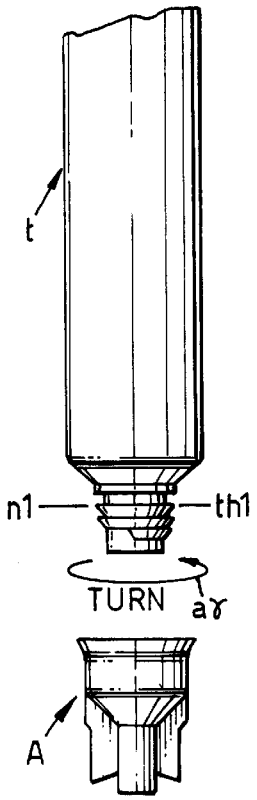
FIGS. 18A–18D are schematic illustrations showing the manufacture of a dual tube dispenser according to the invention.
Figure 18B:
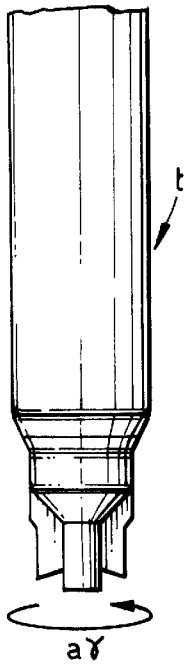

In FIG. 18A the smaller tube (t) which is already filled with a material of one variety (by conventional filling machines) and sealed, is shown about to be fitted with the adapter (A) by a rotary motion of the tube (t) with respect to the adapter (A) along the direction of the arrow (ar). The internal threads (TH) of the adapter (A) and the external threads (th1) around the neck (n1) of the smaller tube (t) provide for a screw fitting of the adapter (A) to the smaller tube. Once the screw fitting of the adapter (A) to the smaller tube (t) is achieved in the manner described above, the assembly of the smaller tube (t) with the adapter (A) as represented in FIG. 18B is obtained.

Figure 18C:
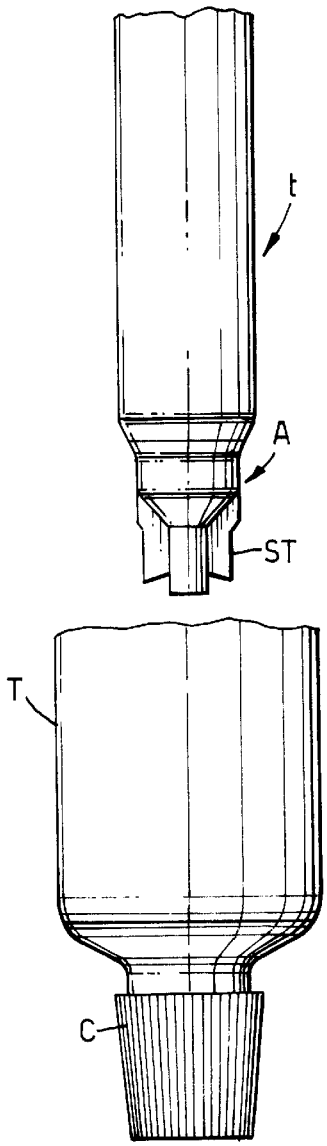
Figure 18D:
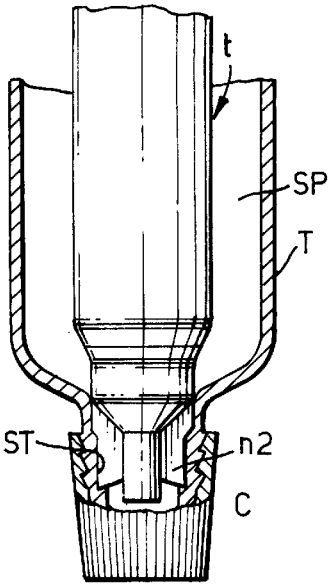

After carrying out the assembling of the tube (t) and the adapter (A) as above, the dual tube dispenser is manufactured by following the process steps illustrated in FIGS. 18C and 18D.

In FIG. 18C, the duly filled and sealed smaller tube (t) with adapter (A) screwed thereon, is shown being inserted into an empty large size tube (T) through the open rear end of said larger tube (T). The mouth of the large size tube (T) being closed by the releasable cap (C). The adapter with the smaller tube (t) is thus inserted therein the larger tube (T) until the adapter studs (ST) provide for press fitting with respect to the internal portion of the neck (n2) of the larger tube (T) to thereby hold and house the smaller tube (t) coaxially within the larger tube (T). Such press fit connection of the adapter (A) and the smaller tube (t) assembled internally within said larger tube (T) is further illustrated in FIG. 18D, where only larger tube (T) is shown in sectional elevational view.

After the assembling of the smaller tube (t) within the larger tube (T) with the adapter (A) as described above, the intermediate space there between the external of the smaller tube (t) with adapter (A) and the internal of the larger tube (T) is filled up with a material of another variety (dissimilar to and having distinct characteristic to that of the material contained in the smaller tube) by means of a filling machine.

The filling-in of the two dissimilar substances in the respective portions as mentioned above can be carried out by any conventional or specially designed tube filling-in aid. After completion of the filling of the respective portions, the open rear end of the larger tube (T) is closed by crimping and sealing by mechanical, ultrasonic or impulse heating procedures. Thus, the dual tube dispenser is adapted to store separately two dissimilar substances thereby avoiding e.g. any chemical reaction and/or problems due to physical incompatibility in storing such substances together.

Figure 19:
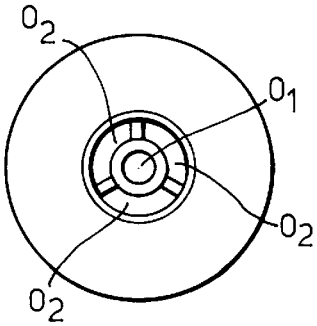
FIG. 19 illustrates in top plan view of the dual tube dispenser of the invention (without the cap closure of larger tube).

For the purpose of dispensing of the substances as stored above from the dual tube dispenser of the invention, the dispenser is subjected to external pressure usually by fingers such as to exert pressure on the deformable body portion of the larger tube (T) and also the smaller tube (t), thereby coextruding the substance contained in the smaller tube (t)

through the opening (O1) and/or the opening (O2) and the material contained in the space (SP) through the opening (O2) at the common outlet end of the dispenser. The openings (O1) and (O2) are clearly illustrated in FIG. 19.

As is evident, the dual tube dispenser of the invention can be obtained by way of effective utilisation of conventional stock tubes, e.g. those with orifices of 35 and 19 mm diameter, by the provision of the adapter as described and disclosed herein. Moreover, the invention can utilize tubes of a variety of diameters, typically from 10–50 mm for the inner, and 15–60 or more for the outer. Also, the adapter of the invention provides for effective utilisation of conventional tube manufacturing and filling aids thereby avoiding modification in manufacturing technology and saving considerable time and expenditure in manufacture of dual tube dispensers.

It is possible to have obvious modifications in the construction of the dual tube dispenser of the invention as exemplified above such as by way of selection of the material of the adapter, selection of the variety of the collapsible stock tubes used, variations in the shape and configuration of the opening for the simultaneous dispensing of the contents of the dual tube dispenser, number and shape of the studs and manner of filling up the contents of the dual tube dispenser of the invention, and all such modifications including perceptibility eg. transparency/translucency of the tubes or product forms as directed to achieve the same objectives as that of the dispenser of the invention come under the scope of the above disclosure.

The adapters and the tubes can be manufactured from any suitable material of construction. The preferred materials of construction for tubes and adapters include metals (such as aluminium), laminated plastics, non-laminated plastics, transparent/translucent/opaque plastics, thermosetting plastics or thermo plastics. Commercially available stock tubes with diameters ranging from 10 mm to 60 mm can be readily used in this invention. The plastic tubes can be either side-seamless, prepared by co-extruding monolayer or multilayer plastic or can be manufactured using conventional techniques from laminated plastics (with or without foil). The present invention can find applications in various areas such as Dental, Food, Skin, Hair, Household cleaning, adhesives with catalyst etc. where one wishes to store two mutually incompatible substances in a common dispenser and deliver both simultaneously to enable interaction between them during use to deliver a unique/enhanced benefit. Some of the possible applications include:

i. Dental-delivery of fluoride in chalk based paste; delivery of hydrogen peroxide gel simultaneously with baking soda based paste; simultaneous delivery of gels of different colours and textures.

ii. Hair- simultaneous delivery of anionic shampoo with cationic conditioner.

The design of the adapter will mainly depend on the end use i.e. delivery of two mutually incompatible substances. The proportions of two substances, their rheology and other physical properties such as density etc. will largely determine dimensions (design) of adapter. These properties will also have a bearing on selection of material of construction for adapter as well as for stock tubes.

What is claimed is:

1. A dual tube dispenser assembly for separate storage of two dissimilar materials and simultaneous dispensing of said materials as and when required comprising:

a small size tube defined by a wall with inside and outside surfaces and terminating in a neck portion, the tube containing one of said materials and having a deformable body portion;

an adapter secured to the neck portion and having at least one passage communicating with the inside surface of said small size tube;

said adapter further defined by a wall with exterior and interior surfaces and at least two studs integrally formed on the exterior surface and a threaded screw provided on the interior surface to co-axially retain said small size tube secured thereto internally and with respect to a large size tube the latter being formed with a wall portion which is deformable and having inner and outer surfaces, the studs being press-fitted and in direct contact with the inner surface of the large size tube;

an intermediate space defined between the outside surface of said small size tube with adapter and the inner surface of the large size tube containing the other of said dissimilar materials such that upon application of force/pressure on the deformable portion of the large size tube said dissimilar materials from said small size tube and said intermediate space dispense simultaneously from a mouth portion of said large size tube; and a closure for said mouth portion of the large size tube.

2. An adapter for use in a dual tube dispenser formed to couple a small size tube with a large size tube, the adapter comprising:

a body portion having a cylindrical base and a tubular extension contiguous and integrally formed with a base;

a threaded screw provided in said cylindrical base to releasably secure said small size tube;

at least two studs integrally formed with and projecting outward from an external surface of said body portion to press fit and hold said small size tube, releasably secured thereto at its cylindrical base portion, co-axially within and with respect to at least a portion of an internal surface of said large size tube;

said body portion defining at least one passage communicating with an internal cavity of said small size tube and at least one further passage defined by at least a portion of the external surface of said body portion and an internal surface portion of the large size tube for communicating with an intermediate space therebetween the external surface of the small size tube and an inside of the large size tube housing said smaller size tube.

3. An adapter as claimed in claim 2 wherein said cylindrical base portion is provided with a contiguously formed shoulder which further extends into said tubular extension.

4. An adapter as claimed in claim 3 wherein each said stud originate from said cylindrical base and extend along said shoulder and up to a portion just below a top edge of said tubular extension.

5. An adapter as claimed in claim 3 wherein said tubular extension has an internal shape and configuration to define a circular and concentric inner passage with respect to an orifice of the small size tube.

6. An adapter as claimed in claim 3 wherein said passage communicating with said small size tube further comprise port holes provided in said shoulder of said body portion.

7. An adapter as claimed in claim 2 wherein said passage communicating with said small size tube further comprise port holes provided in sides of said tubular extension.

8. An adapter as claimed in claim 2 wherein said tubular extension is provided to have a non-concentric opening with respect to its cylindrical base.

9. An adapter as claimed in claim 8 wherein said cylindrical base at a top along a substantially semicircular portion thereof is extended to an upwardly tapering shoulder and a remaining semicircular portion thereof extends vertically upwards to constitute said tubular extension on said cylindrical base having a non-concentric semicircular shaped said inner passage communicating with the small size tube.

10. A method for assembling a dual tube dispenser for separate storage of two dissimilar materials and simultaneously dispensing of said materials as and when required comprising:

providing a duly filled and sealed small size tube containing one said dissimilar material with a releasable closure fitted thereon;

replacing the releasable closure of the filled small size tube by an adapter to thereby secure the adapter with respect to the neck of said small size tube;

providing an open ended empty large size tube with its release closure fitted thereon;

inserting the small size tube fitted with the adapter into said large size tube through an open end thereof, the adapter comprising a body portion defined by an external wall with at least two studs projecting outwardly therefrom, the studs being unitarily formed with the body portion; and press fitting an outer edge of the studs against an internal surface of said large size tube to thereby hold the said small size tube co-axially within said large size tube;

filling in an intermediate space defined by an external surface of the small size tube with the adapter and the internal surface of the large size with the other of said dissimilar materials through the open end of said large size tube by a filling machine followed by, crimping and sealing the open end of the large size tube after filling is completed to thereby provide the dual tube dispenser.

* * * * *